United States Patent [19]

Hayes

[11] 4,426,787

[45] Jan. 24, 1984

[54] BOW SIGHT

[76] Inventor: James C. Hayes, 9190 Victory Hwy., Painted Post, N.Y. 14870

[21] Appl. No.: 397,678

[22] Filed: Jul. 12, 1982

[51] Int. Cl.[3] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 2,991,556 | 7/1961 | Wilchek | 33/265 |
| 3,798,783 | 3/1974 | Carella | 33/265 |
| 3,875,674 | 4/1975 | Davidson | 33/265 |
| 4,263,718 | 4/1981 | Smith | 33/265 |

*Primary Examiner*—Richard R. Stearns

*Attorney, Agent, or Firm*—Burton R. Turner

[57] ABSTRACT

An archery bow sight is set forth which may be affixed to a conventional bow for a vertical sighting irrespective of the rotation of the bow. The bow sight includes a plurality of curved pins representing different target ranges, but with each individual curved pin being a constant distance from the axis of the arrow such that the curvature of the pins allows for the bow to be tilted without affecting accuracy.

10 Claims, 3 Drawing Figures

BOW SIGHT

BACKGROUND OF THE INVENTION

Various techniques of archery sighting have been practiced in the past. Some individuals utilize the tip of the arrow as a sighting aid and others concentrate on the target. The first of these techniques is generally referred to as the gap system or point of aim shooting, and the other is known as instinctive shooting.

An archer who utilizes instinctive shooting draws the bow, adjusts his sight picture until it feels good, and then releases the arrow. Although horizontal or windage sighting may be accomplished by sighting along the shaft of the arrow, elevational sighting must be done without any close reference. Whereas a relatively flat trajectory of a rifle allows the sight line to be nearly parallel with the axis of the bore, in archery the arrow must be propelled in an initial elevational direction considerably above the target so that it will arrive on target, since it is deflected downwardly by gravity along its path of flight. Depending upon the distance to the target, the elevational deflection of the arrow may be several feet in magnitude. Thus, when a front sight is attached to a bow and is adjusted to be correct when the bow is vertical, the orientation of the bow becomes critical since any shot with the bow canted to the left or right will be horizontally off target by as much as several feet. In fact, as shown by U.S. Pat. No. 3,279,071, the archery sighting device disclosed therein is for the purpose of maintaining the bow in a vertical position.

Included in the Prior Art is U.S. Pat. No. 2,918,049 which is directed to an archery bow having a view-finding reel which requires interpolation of the target's apparent position between the axis and circumference of the reel along a selected imaginary radial line in an appropriate quandrant of the reel's circle. The construction and mounting of the reel are appropriate for its purpose as a reel and view finder, but not as a sight, since range references are not provided and the aiming is done through interpolation and practice. Further, the sighting device shown in U.S. Pat. No. 3,505,985 is for compensating for elevation and windage, rather than rotation of the bow as in the instant invention.

U.S. Pat. No. 3,849,894 discloses an adjustable sighting device for archery bows which has a separate attachment which is preset to indicate the orientation of the bow. U.S. Pat. No. 3,289,300 discloses a bow sight having a tubular ring which provides a frame of reference for sighting even when the bow is laterally inclined, but requires an adjustment of the positionment of the tubular ring for each lateral inclination of the bow. Finally, U.S. Pat. No. 3,027,648 relates to a rather complex archery sight having a sighting window with a sighting edge which may be calibrated and rotated by adjustment screws so as to provide a vertical sight line when the bow is canted, thus requiring numerous adjustments prior to the shooting of arrows when the canting of the bow is varied.

The present invention has overcome the problems of requiring numerous adjustments to bow sights when the bow is tilted from a vertical position by providing a fixed simplified bow sight which may be used at virtually any angle from the vertical as desired without requiring adjustment.

SUMMARY OF THE INVENTION

In its simplest form, the present invention is directed to a simplified fixed bow sight having a plurality of curved pins which function as a reference for vertical sighting. Horizontal sighting is accomplished by sighting along the arrow shaft. The curvature of the pins allows the bow to be tilted without affecting accuracy and without requiring any adjustment of the bow sight. Thus, the restriction of prior art bow sights that the bow must always be held in the same relationship with the vertical, or an additional adjustment to the sight must be made, has been eliminated.

It thus has been an object of the present invention to provide a simple fixed bow sight which provides a reference for vertical sighting while permitting the archer to rotate the bow about the axis of the arrow without disturbing the aiming process.

DESCRIPTION OF THE PREFERRED EMBODIMENTS

Figure 1:
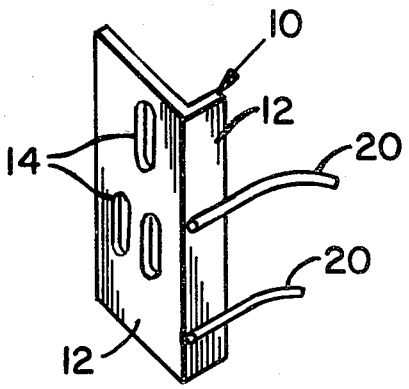
FIG. 1 is a perspective view of a bow sight embodying the present invention.

Referring now to the drawings, a bow sight 10 embodying the present invention is shown having a mounting bracket 12 provided with slots or openings 14 for receiving screws or fasteners 16 for rigidly mounting the bracket to the side of a bow 18. A plurality of sighting pins 20 are fixedly secured to or formed integrally with bracket 12.

Figure 2:
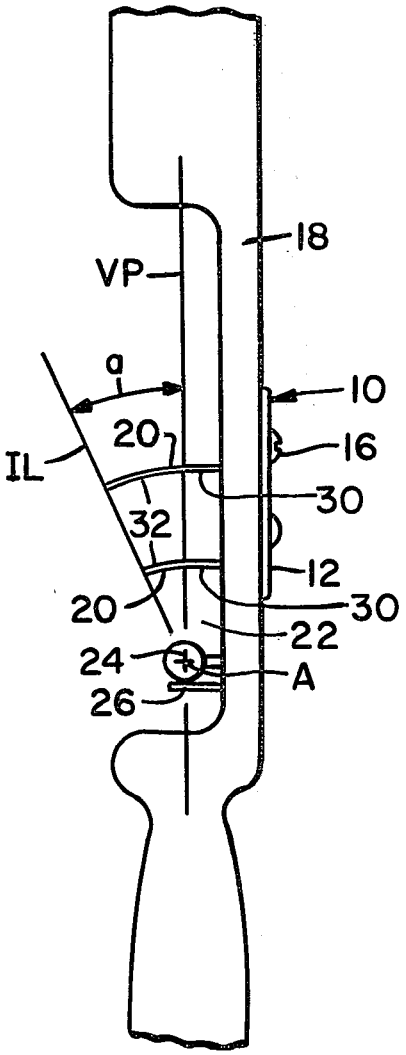
FIG. 2 is a fragmental elevational view of a bow from the rear or aiming side thereof showing my new bow sight attached thereto, with the bow being in a vertical orientation.
Figure 3:
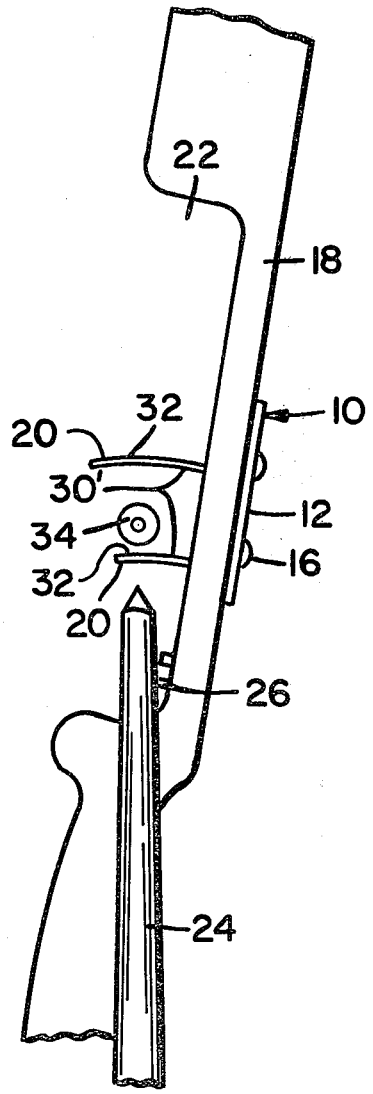
FIG. 3 is a view similar to FIG. 2, but with the bow tilted with respect to the vertical and showing the sighting of an arrow with respect to a target.

As shown particularly in FIG. 2, the sighting pins 20 protrude within the sight window 22 of the bow 18 from the mounting bracket 12. In the case of a right handed bow, the pins protrude to the left as shown in FIGS. 2 and 3. An arrow 24 is shown positioned upon an arrow rest 26, and a vertical plane, represented by line VP, is shown passing through the axis A of the arrow 24. Each of the pins 20 is shown in FIG. 2 as having a straight or linear portion 30 and an arcuate or curvilinear portion 32. The straight portion 30 extends perpendicular to a vertical axis of the bow into the sight window from the side of the bow until it perpendicularly intersects vertical plane VP passing through the axis A of arrow 24. The arcuate or curved portion 32 of the pins 20 each extends from the vertical plane VP with a radius equal to their respective distances from the axis A of the arrow 24. Thus, vertical plane VP intersects the intersection of linear portion 30 and curvilinear portion 32, and curved portions 32 describe segments of concentric circles about arrow 24 and its axis A.

Although the pins 20 are shown in FIG. 2 as comprising both an arcuate or curvilinear portion 32 and a linear portion 30, the entire pin 20 may be arcuate if desired. That is, each sighting pin 20 may have an arc formed with a predetermined radius from the axis A of arrow 24, as shown in FIG. 3. Thus when a vertical plane passes through the axis A of arrow 24, when the bow is either in a vertical or tilted position, the pins 20 will have curvilinear portions 32 outwardly of such plane and curvilinear portions 30' inwardly thereof toward the bow.

The sighting pins 20 terminate in an end portion lying along an imaginary line IL which passes through the axis A of arrow 24 and is at a predetermined angle a from the vertical plane VP. Although the angle a may be varied as desired, an angle of about 20° is usually sufficient for most applications.

The bracket 12 may be made of a suitable metal and the sighting pin 20 may be made of wire welded, braised or soldered to the bracket, or the bracket and pins may be made of a suitable plastic. The pins of course are made of a construction so as not to be easily bent, are large enough and of a color to be easily seen, but yet are small enough so as not to interfere with the observation of the target. The essence of the invention is in the geometry of the sight itself rather than the particular form of such geometry. That is, the sighting means may be in the form of pins 20 or may take the form of lined arcs on a transparent window or even slots formed in such a window.

The bow sight of the present invention may be utilized in a manner similar to the sighting pins of the prior art such as shown in U.S. Pat. No. 3,849,894, however, the sighting pins of the prior art which are only good for shooting when the bow is in a vertical plane, are replaced by the arcuate sighting pins of the present invention. That is, the sighting pins of the present invention appear in the sight window as arcs rather than points. Horizontal sighting is accomplished by sighting down the arrow and pointing the arrow at the target, since the anchor point of the knock end of the arrow is under the sighting eye. Vertical aiming is accomplished by holding the bow so that the target appears at the correct elevation with respect to the curved pins, considering the distance to the target.

Although I have disclosed the use of two sighting pins 20, any number may be used as desired. The upper sighting pin may, for example, be positioned to correspond to a range of about 10 yards, and the lower one to about 30 yards. In view of the fact that the pin radius of curvature is constant and must match its distance from the arrow irrespective of the orientation of the bow, since the curvature of curved portion 32, 30' of each pin 20 is in fact a fixed radius from the axis A of the arrow 24, there is no need to adjust the vertical position of the pin when the bow is tilted. An archer with a new sight embodying my present invention would determine through practice the range at which he would hold a pin directly on the target. At some intermediate range, the archer would place the target at the relationship judged to be appropriate between the pins.

Referring to FIGS. 3, a sight picture is shown for a target 34 positioned at about 25 yards. The bow 18 is first moved side to side so that the arrow points at the target. Next, the bow is held so that the target appears about two-thirds of the way from the top (10 yard) pin toward the bottom (30 yard) pin. It will be noted that the bow 18 is rotated about the axis of the arrow 24 so that the bow is not within a vertical plane. With the present invention, the bow 18 may be rotated anywhere within the limits of the angle a and not change the sight picture or the accuracy of the shot. Further, the distance to the target may also be changed and no adjustment to the bow sight pin is required since the fixed sighting pins have constant predetermined ranges from with which to sight upon the target.

Through the use of the present invention it is possible to add a further degree of freedom in archery shooting which was heretofore unknown. That is, the archer is now free to rotate the bow about the axis of the arrow without disturbing the aiming process. This flexibility not only removes an important source of error but also allows shots to be taken which would be impossible with conventional sights, and is especially beneficial while hunting from restricted stands such as in trees. Further, the sight materially simplifies the aiming procedure in view of the fact that no adjustments are required irrespective of the orientation of the bow and the distance to the target.

Although the now preferred embodiments of the invention have been disclosed, it will be apparent to those skilled in the art that various changes and modifications may be made thereto without departing from the spirit and scope thereof as defined in the appended claims.

I claim:

1. An archery bow sight adapted to be mounted on a conventional bow comprising, means for mounting the bow sight on a bow, sighting means extending from said mounting means in a fixed predetermined orientation with respect thereto, said sighting means having a linear portion adjacent said mounting means and a curvilinear portion extending outwardly from said linear portion, said curvilinear portion having a constant curvature about an axis lying within a plane intersecting the intersection between said curvilinear portion and said linear portion of said sighting means, said curvilinear portion terminating in an end portion such that a line passing therethrough and intersecting said axis forms a predetermined angle with said plane, said means for mounting the bow sight including a bracket rigidly mounted on the bow adjacent a sight window of the bow, said sighting means including a plurality of sighting pins which protrude into the sight window of the bow from said mounting bracket, each of said sighting pins having a linear portion and a curvilinear portion, the intersection of said linear and curvilinear portions of said sighting pins lying within a vertical plane passing through the axis of an arrow loaded for firing in the sight window of the bow when the bow is in a vertical position, each of said curvilinear portions of said plurality of sighting pins having a curvature with a radius equal to its respective distance from said axis to thus describe a plurality of segments of concentric circles about said axis, and a line joining terminal end portions of said curvilinear portions intersecting said axis and forming a predetermined angle with said plane.

2. An archery bow sight adapted to be mounted on a conventional bow comprising, means for mounting the bow sight on a bow, sighting means extending from said mounting means in a fixed predetermined orientation with respect thereto, said sighting means having a linear portion adjacent said mounting means and a curvilinear portion extending outwardly from said linear portion, said curvilinear portion having a constant curvature about an axis lying within a plane intersecting the intersection between said curvilinear portion and said linear portion of said sighting means, said curvilinear portion terminating in an end portion such that a line passing therethrough and intersecting said axis forms a predetermined angle with said plane, said sighting means including a plurality of spaced-apart linear portions extending from said mounting means, and each of said linear portions having a curvilinear portion extending outwardly therefrom and describing segments of concentric circles about said axis.

3. An archery bow sight as defined in claim 2 wherein said sighting means includes at least one sighting pin extending from said mounting means, said sighting pin having a linear portion adjacent said mounting means and a curvilinear portion extending outwardly from said linear portion, and said curvilinear portion having a radius equal to the distance between said axis and the intersection between said curvilinear and linear portions of said sighting pin.

4. An archery bow sight as defined in claim 2 wherein said means for mounting the bow sight includes a bracket rigidly mounted on the bow adjacent a sight window of the bow, and said sighting means includes a plurality of sighting pins which protrude into the sight window of the bow from said mounting bracket.

5. An archery bow sight adapted to be mounted on a conventional bow comprising, bracket means for mounting the bow sight on a bow, sighting means extending from said bracket means for projecting within a sight window of a bow in a fixed predetermined orientation with respect thereto, said sighting means including a plurality of curvilinear sighting pins, each said sighting pin having a constant curvature about a common axis and formed with a radius equal to its distance from said common axis, and said sighting pins forming a plurality of segments of concentric circles about said common axis.

6. An archery bow sight adapted to be mounted upon a conventional bow having a sight window and means for positioning on arrow for shooting within said window comprising, bracket means for mounting said bow sight on said bow adjacent said sight window, a plurality of fixed sighting means spaced apart along said bracket means and projecting within said sight window, said plurality of sighting means each having a first portion adjacent said bracket means and a second portion extending outwardly from said first portion, the intersection between said first and second portions of each of said sighting means lying within a vertical plane passing through the axis of an arrow mounted on said arrow positioning means when said bow is in a vertical position, at least said second portion of each of said sighting means being curvilinear and having a constant curvature formed with a radius equal to its distance from said axis as measured along said plane, and said curvilinear portions forming a plurality of segments of concentric circles about said axis.

7. An archery bow sight as defined in claim 6 wherein said plurality of fixed sighting means includes a plurality of sighting pins vertically spaced apart on said bracket means when said bow is in a vertical position, each sighting pin providing an elevational reference for a different target distance, and the distance between said axis and each sighting pin is constant along the extent of said curvilinear portion irrespective of the rotation of said bow about said axis.

8. An archery bow sight as defined in claim 6 wherein said curvilinear portions of each of said sighting means terminates in an end portion such that a line passing through said end portions intersects said axis and forms a predetermined angle with said vertical plane.

9. An archery bow sight as defined in claim 6 wherein said plurality of fixed sighting means includes a plurality of nonadjustable sighting pins formed as an integral part of said bracket means.

10. An archery bow sight as defined in claim 6 wherein said curvilinear portions of each of said sighting means terminates in an end portion such that a line extending through said end portions and intersecting said axis forms an angle of at least 20° with said vertical plane.

* * * * *